US006752624B2

(12) United States Patent
Iwatani et al.

(10) Patent No.: US 6,752,624 B2
(45) Date of Patent: Jun. 22, 2004

(54) SOAKING APPARATUS

(75) Inventors: Nobuo Iwatani, Akiruno (JP); Akira Nishio, Chikushino (JP); Masao Takahashi, Tachikawa (JP); Masaharu Kusuhara, Kasuya-gun (JP)

(73) Assignee: Showa Manufacturing Co., Ltd., Fukuoka-ken (JP)

( * ) Notice: Subject to any disclaimer, the term of this patent is extended or adjusted under 35 U.S.C. 154(b) by 0 days.

(21) Appl. No.: 10/305,505

(22) Filed: Nov. 27, 2002

(65) Prior Publication Data

US 2003/0118965 A1 Jun. 26, 2003

(30) Foreign Application Priority Data

Dec. 25, 2001 (JP) ..... 2001-392601

(51) Int. Cl.[7] ..... F27D 1/04

(52) U.S. Cl. ..... 432/247; 373/119; 219/406

(58) Field of Search ..... 432/31, 178, 192, 432/247–251; 219/391, 395, 406–407, 411; 392/416; 373/109, 119

(56) References Cited

U.S. PATENT DOCUMENTS 1,350,876 A * 8/1920 Mayer et al. ..... 373/119
4,137,966 A * 2/1979 Ulrich et al. ..... 165/206
5,573,688 A * 11/1996 Chanasyk et al. ..... 219/388
6,067,820 A * 5/2000 Silander et al. ..... 65/114

* cited by examiner

*Primary Examiner*—Gregory Wilson
(74) *Attorney, Agent, or Firm*—Jordan and Hamburg LLP

(57) ABSTRACT

Soaking apparatus to treat materials which require higher accuracy in soaking and improved cleanliness. The soaking apparatus includes a heat treatment apparatus having walls, a ceiling and a floor, each divided into a plurality of sections, a heater block mounted on each section, a thermal sensor mounted to each heater block, and a thermal controller to control heating of the heater blocks based on a temperature measured by the thermal sensor.

13 Claims, 6 Drawing Sheets

FIG.6A
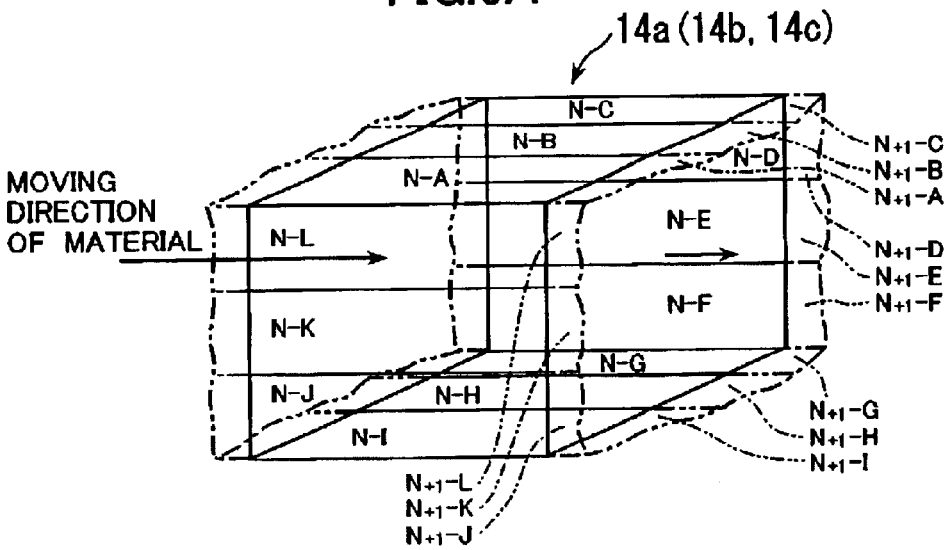
FIG.6B
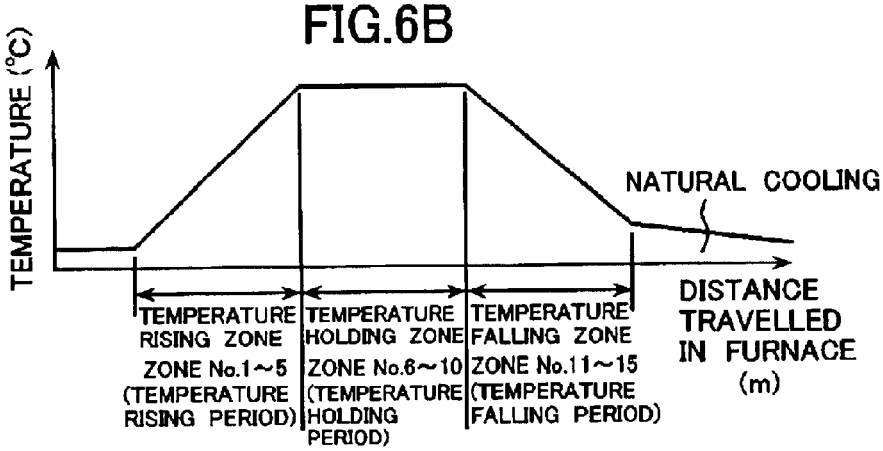
FIG.6C
| | ZONE NUMBER | | | |
|---|---|---|---|---|
| | ~ | N | N+1 | ~ |
| A | ~ | 480 | 530 | ~ |
| B | ~ | 500 | 550 | ~ |
| C | ~ | 480 | 530 | ~ |
| D | ~ | 480 | 530 | ~ |
| E | ~ | 500 | 550 | ~ |
| F | ~ | 520 | 570 | ~ |
| G | ~ | 520 | 570 | ~ |
| H | ~ | 540 | 590 | ~ |
| I | ~ | 520 | 570 | ~ |
| J | ~ | 520 | 570 | ~ |
| K | ~ | 500 | 550 | ~ |
| L | ~ | 480 | 530 | ~ |

SOAKING APPARATUS

BACKGROUND OF THE INVENTION

The present invention relates to a soaking apparatus for soaking materials to be treated by heating.

Conventionally, a heat treatment furnace for treating a material to be treated in the furnace at a uniform temperature has a heat source such as a burning gas and an electric heater. While an atmosphere in the furnace is stirred with a circulation fan in order to uniformize a temperature in the furnace, a temperature at a certain point in the furnace which represents the temperature in the furnace is measured, and an operation of a heat source heating the inside of the furnace as well as the circulating fan is controlled so that the temperature at the representative point is maintained at a predetermined value.

An example of a material to be treated which requires soaking is an electronic device substrate. An electronic device substrate is made of one of glass, ceramics and plastic, or comprises a base made of one of glass, ceramics and plastic with a layer of one of metal, an inorganic material and an organic material formed on a surface of the base, which add desired functions on the base surface, respectively. An electronic device substrate subjected to a heat treatment has no differences in quality with a desired accuracy in the dimension. In these days functional layers formed on substrate surfaces have more minute pattern spaces, which increasingly require a uniformity of a layer of higher accuracy. In addition, as dimensions of screens of display devices become larger, an electronic device substrate having a larger dimension over 1000 mm×1000 mm is needed.

Furthermore, in case of an electronic device substrate, particles such as dust in an atmosphere in a heat treatment furnace, adhearing to a substrate surface during a heat treatment step, lead to undesirable quality. Therefore, an atmosphere in a furnace requires a high degree of cleanliness. As a method to enhance the cleanliness, a gas such as nitrogen or air which has been heated by a heat source such as a gas or an electric heater outside a heat treatment furnace is filtrated with a heat-resistant particle collection filter, and then fed into the furnace. Since the gas or air fed to the heat treatment furnace is of a high temperature, a heat-resistant particle collection filter made of glass fibers or organic fibers is used.

According to the above-described conventional heat treatment method, the temperature of the atmosphere in the heat treatment furnace is only controlled at a representative point and is not controlled at other points. Thus, the overall furnace does not have a uniform temperature, making it difficult to treat materials having large surfaces at a uniform temperature.

As the conventional method is to control soaking of a material to be heated during a temperature holding period, it is also difficult to control rates of temperature rising and temperature falling during a temperature rising period and a temperature falling period before and after the temperature holding period.

When treating a large-sized electronic device substrate, the temperature in a heat treatment furnace cannot be raised with respect to each area individually, leading to a non-uniform temperature in the furnace. Therefore, it is difficult to provide an electronic device substrate having a layer of uniform quality.

At a high temperature of over 300° C., the durability of a heat-resistant particle collection filter deteriorates, and the filter generates particles by itself, thereby degrading cleanliness inside a heat treatment furnace. Additionally, in this case, a circulation fan is used to stir an atmosphere in the furnace to uniformize the temperature in the furnace. Then, a substrate shakes or vibrates to generate dust by crushing or wearing, which causes new particles to scatter in the furnace. Thus, it is no longer possible to maintain cleanliness inside the furnace.

As described above, the conventional methods involve a variety of problems.

SUMMARY OF THE INVENTION

An object of the present invention is to provide a soaking apparatus used for treating a material which requires a higher degree of accuracy in soaking as well as greater cleanliness.

In order to accomplish the above object, a soaking apparatus according to the present invention is a heat treatment apparatus for soaking a material to be treated comprising a heat treatment furnace having walls, a ceiling and a floor, each surface of said walls, said ceiling and said floor being divided into a plurality of sections, at least one heater block mounted on each of said sections, a thermal sensor provided to said heater block, and a thermal controller to control heating of the heater block based on a temperature measured by the thermal sensor.

The heat treatment furnace of the above soaking apparatus is a batch type furnace. Preferably, a part of the walls of the furnace is provided with a door member which opens when a material to be treated is inserted and removed. The furnace can treat materials both in a plate-like form and in a solid form.

As the heater block, a plate-like form electric heater or a ceramic infrared heater may be used, for example. It is preferable to employ heaters which generate as few particles as possible.

As the heater block is mounted on each surface of the walls, ceiling and floor, respectively, it is possible to radiate heat from a predetermined position in a predetermined direction, thereby raising a temperature of a material up to a predetermined value as well as maintaining the temperature.

Furthermore, a soaking apparatus according to the present invention is a heat treatment apparatus for soaking a material to be treated comprising a heat treatment furnace having walls, a ceiling and a floor, each surface of said walls except for the walls on side of an inlet and an outlet of the furnace, said ceiling and said floor being divided into a plurality of sections, at least one heater block mounted on each of said sections, a thermal sensor provided to said heater block, a thermal controller to control heating of the heater block based on a temperature measured by the thermal sensor, and a conveyor disposed in the heat treatment furnace to carry the material to be treated from the inlet of the furnace to the outlet of the furnace.

The heat treatment furnace of the above soaking apparatus is a continuous type furnace, in which a material to be treated is carried from the inlet of the furnace to the outlet of the furnace by the conveyor. The material can be passed through a space surrounded by the heater blocks, each of which has been heated to a predetermined temperature, which enables a uniform temperature of the material to be easily controlled.

Whether the heat treatment furnace is the batch type or the continuous type, a cooling device to cool down the walls, the ceiling and the floor of the furnace may be preferably provided on outer surfaces of the walls, the ceiling and the floor on opposite sides to surfaces on which the block heater is mounted.

The temperature in the heat treatment furnace rises up to 300° C. or more, which, however, is not high enough to melt down the walls, ceiling and floor. Therefore, it is not necessary to consistently operate the cooling device. Nevertheless, the temperature, when becoming extremely high by the heater blocks, can be readily lowered to an appropriate level by the cooling device. In addition, after a temperature has been raised and held by the block heaters, a temperature falling rate can be controlled.

Preferably, a heat-resistant glass to separate areas on which the heater block is mounted from a space inside the heat treatment furnace may be provided in front of the heater blocks on a side facing to the center of the furnace.

With the heat-resistant glass for separating the areas, dust, if generated from the heater blocks, cannot enter the space inside the furnace and does not affect a material to be treated, improving cleanliness of an atmosphere inside the furnace.

Preferably, the material to be treated may be a substrate made of one of glass, ceramics and plastic, or comprises a base made of one of glass, ceramics and plastic with a layer made of one of metal, an inorganic material and an organic material formed on a surface of the base. Furthermore, a cassette to hold a plurality of materials to be arranged in parallel to each other may be detachably mounted in the heat treatment furnace.

Plate-like materials to be treated may be arranged in a vertical or horizontal position. Each of the heater blocks may have an elongated form, for example, to be disposed in parallel to or vertical to the materials.

When plate-like materials to be treated are carried by a conveyor, the cassette may preferably be disposed so that a normal line to the materials are in parallel to a moving direction of the conveyor.

By the above structures, a large amount of materials can be treated at one time, and the heater blocks accurately control the temperature.

BRIEF DESCRIPTION OF THE DRAWINGS

FIG. 6A is a diagram explaining an arrangement of heater blocks mounted on the furnace;

FIG. 6B is a graph of a set pattern of a temperature in the furnace;

FIG. 6C is a table showing a digitalized set pattern of each heater block.

DESCRIPTION OF THE PREFERRED EMBODIMENT

Preferred embodiments of the present invention are explained below.

(First Embodiment)

Figure 1B:
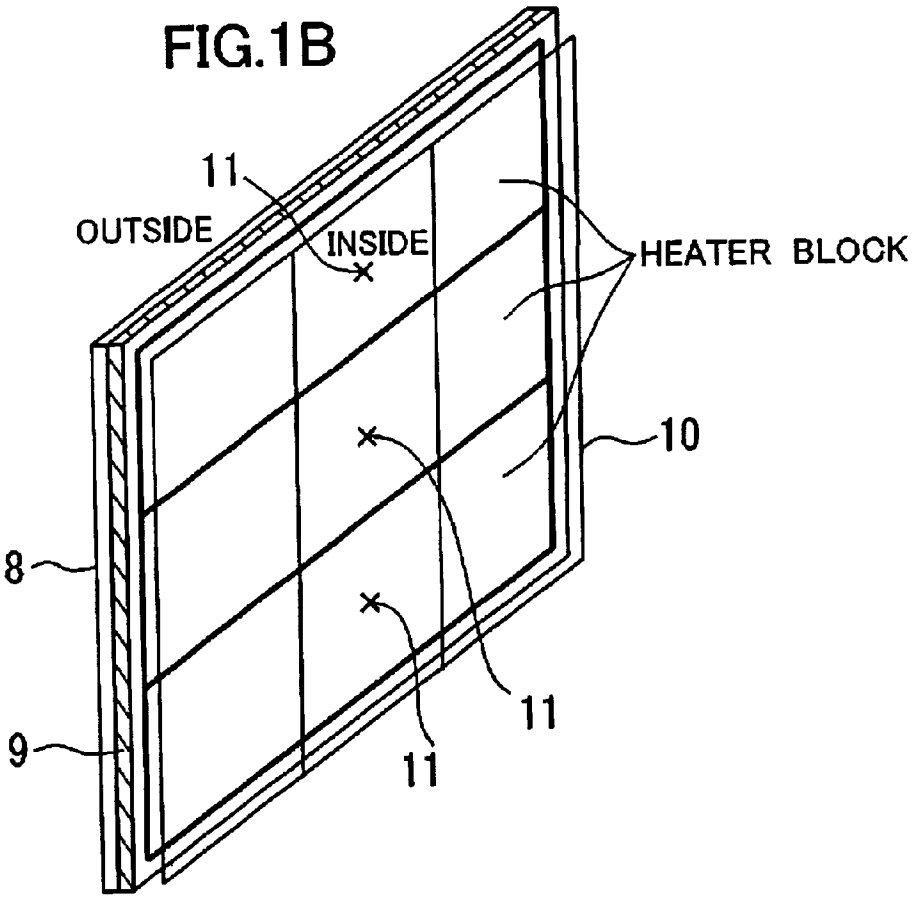
FIG. 1B is a perspective view illustrating a wall structure of the furnace of FIG. 1A.
Figure 1A:
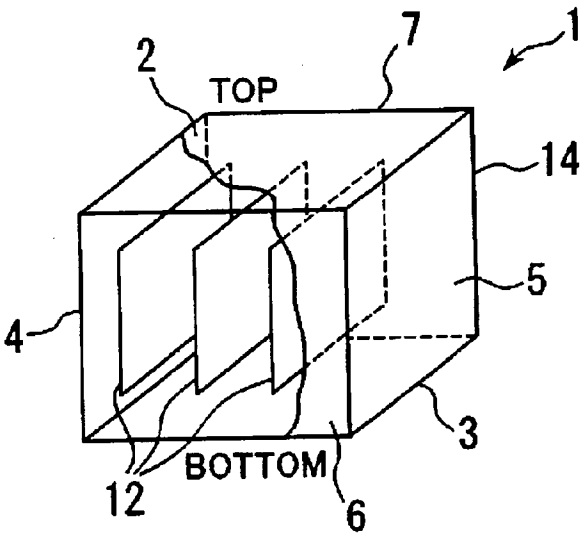
FIG. 1A is a partially cut-out perspective view of a heat treatment furnace of a soaking apparatus according to the present invention.
Figure 2:
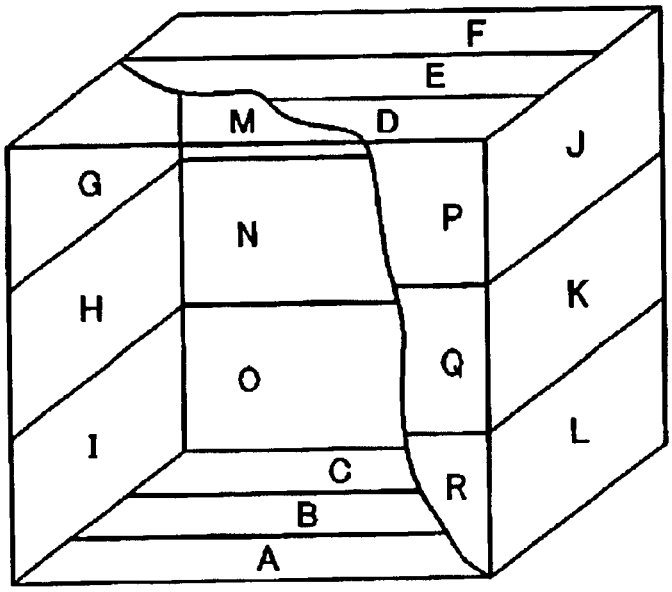
FIG. 2 is a partially cut-out perspective view showing sections formed on walls, a ceiling and a floor of the furnace of FIG. 1A.

FIG. 1A is a partially cut-out perspective view of a heat treatment furnace of a soaking apparatus according to the present invention, FIG. 1B is a perspective view illustrating a wall structure of the furnace of FIG. 1A, and FIG. 2 is a partially cut-out perspective view showing sections formed on walls, a ceiling and a floor of the furnace of FIG. 1A.

A heat treatment furnace 14 of a soaking apparatus 1 of this embodiment is a batch type furnace and has a ceiling 2, a floor 3, a front wall 4, a rear wall 5, a left wall 6 and a right wall 7. Each inner surface of the ceiling 2, the floor 3 and the walls 4 to 7 is divided into three sections.

As shown in FIG. 2, the heart heat treatment furnace 14 is provided with heater blocks A, B and C on a surface of the floor 3, heater blocks D, E and F on a surface of the ceiling 2, heater blocks G, H and I on a surface of the front wall 4, heater blocks J, K and L on a surface of the rear wall 5, heater blocks M, N and O on a surface of the right wall 7, and the heater blocks P, Q and R on a surface of the left wall 6.

Referring to one of the walls shown in FIG. 1B as an example, each of the heater blocks is mounted on each of the divided sections inside the heat treatment furnace via an insulating material 9. A cooling device 8 is mounted on an outer surface of the wall outside the heat treatment furnace 14, and a heat-resistant glass is mounted in front of the heater block on a side facing to a center of the heat treatment furnace 14.

As the heater block, it is preferable to use an infrared heater, which has higher heating efficiency. Electricity and gas, for example, can be employed as a heat source of the infrared heater.

Adjacent to each center of the heater blocks, a thermal sensor 11 is provided. An exact position of the thermal sensor 11 is to be a position in which temperature is the same as an average temperature of the respective heater block. After such position is determined, the thermal sensor is mounted.

As the heater block is mounted on an inner side of the heat treatment furnace 14 than the insulating material 9, the heat does not unnecessarily leak outside the heat treatment furnace 14. The cooling device 8 is mounted on an outer side of the heat treatment furnace 14 than the insulating material 9 to completely block the heat of the heater block. Also, the cooling device 8 cools down the temperature inside the heat treatment furnace 14, either via the walls or directly, thereby controlling a temperature of an atmosphere inside the heat treatment furnace 14 with higher accuracy. As the cooling device, either a water-cooling type or an air-cooling type may be employed.

The heat-resistant glass 10 separates areas where the heater blocks A to R are mounted from a space inside the heat treatment furnace 14 where a material 12 to be heated is disposed, and prevents dust generated by the heater blocks A to R from invading the space inside the furnace, improving cleanliness in the furnace.

Figure 3:
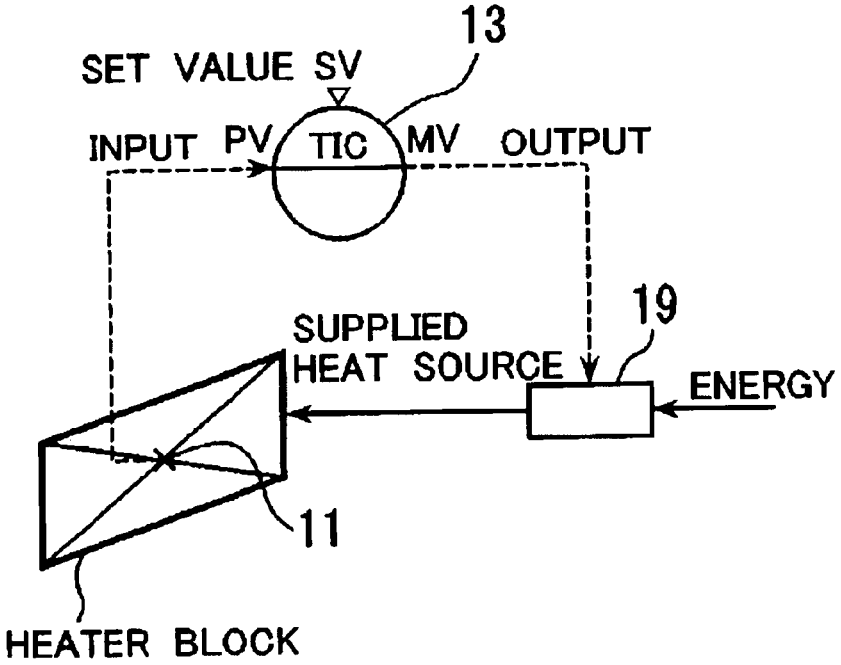
FIG. 3 is a diagram explaining a structure for controlling a thermal controller connected to a thermal sensor.

FIG. 3 is a diagram explaining a structure for controlling a thermal controller connected to the thermal sensors 11.

Each of the thermal sensors 11 is connected to a thermal controller 13. The thermal controller 13 is connected to a converter unit 19 which supplies energy, such as electric current for example, as a supplied heat source to the heater blocks A to R.

The thermal controller 13 feedbacks a temperature measured by each of the thermal sensors 11 to individually control heating of each of the heater blocks A to R.

Figure 4A:
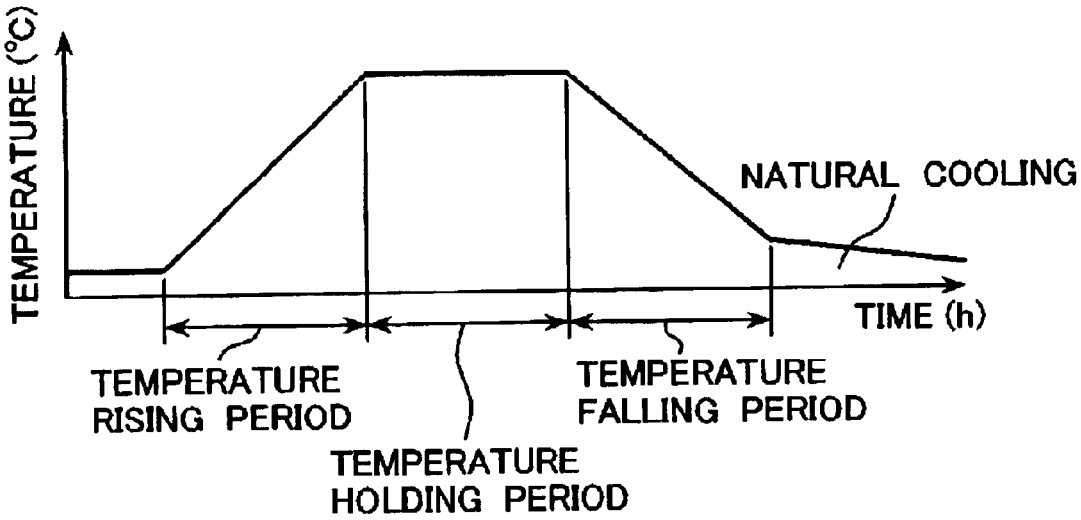
FIG. 4A is a graph showing a pattern of a temperature in the heat treatment furnace set by the thermal controller.
Figure 4B:
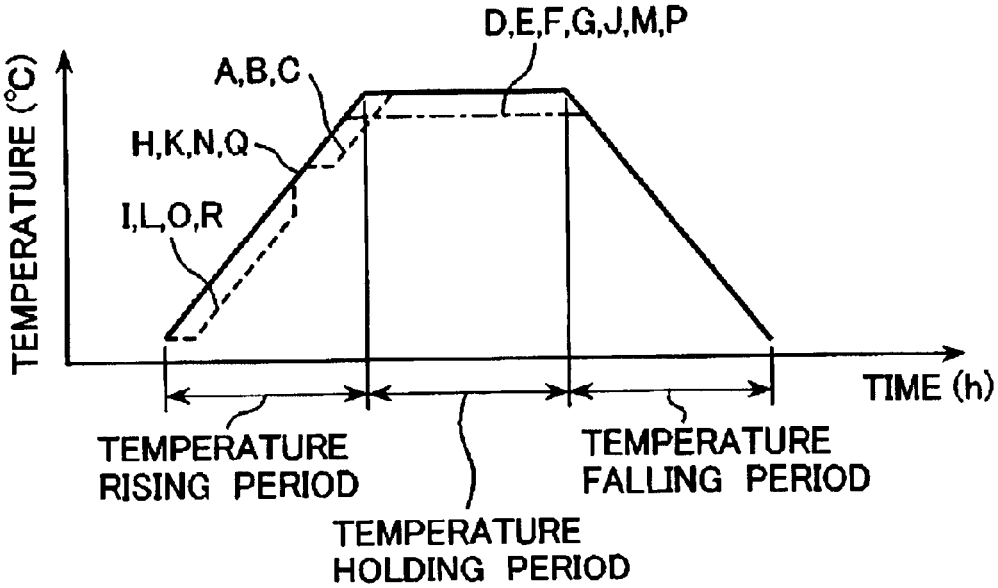
FIG. 4B is a diagram explaining a heating condition of each heater block to realize the set pattern.

FIG. 4A is a graph showing a pattern of a temperature in the heat treatment furnace set by the thermal controller, and FIG. 4B is a diagram explaining a heating condition of each heater block to realize the pattern.

In the thermal controller 13, at least a temperature rising time, a temperature holding time, a temperature falling time, and a temperature to be held are set in advance. Also a rate of a temperature change per hour in a temperature rising period and a temperature falling period can be optionally determined.

As the material 12 to be treated, a substrate made of one of glass, ceramics and plastic, or a plate like substrate comprising a base made of one of glass, ceramics and plastic with a layer of one of metal, an inorganic material and an organic material formed on a surface the base is used.

Explained below is a thermal control method of this embodiment.

The material 12 to be treated mounted in a cassette (not shown) is disposed in the heat treatment furnace 14 before heated with the thermal controller 13. During the temperature rising period, the material 12 is first heated by the heater blocks I, L, O and R mounted on lower rows of the walls adjacent to the material 12. Next, the material 12 is heated by the heater blocks H, K, N and Q mounted on middle rows of the walls. At the time from a latter half of the temperature rising period to a beginning of the temperature holding period, the heater blocks A, B and C mounted on the floor heat up the material 12.

In the temperature holding period after the temperature of the atmosphere in the heat treatment furnace 14 has reached the temperature to be held, the material 12 is heated by the heater blocks D, E and F mounted on the ceiling and the heater blocks G, J, M and P mounted on upper rows of the walls. If the temperature in the furnace exceeds the set value of the temperature to be held, the thermal controller 13 executes feedback to lower the temperature in the furnace.

During the temperature falling period, the thermal controller 13 controls the temperature in the furnace so that the temperature falls in a desired falling pattern. The temperature falling rate is controlled by the thermal controller 13, which controls the temperature by an appropriate block selected from the heater blocks A to R. A control pattern by the thermal controller 13 is not limited to the above pattern, and other set pattern can naturally be employed.

In the batch type heat treatment furnace 14, the heater blocks A to R are individually controlled to be heated, and the heat treatment furnace 14 is provided with the heating means, which are the heater blocks A to R, and the temperature lowering means, which is the cooling device. Thus, the heating and cooling conditions can be controlled to have a desired thermal pattern and, as shown in FIG. 4A, a thermal profile of a material which is soaked with a highly accurate control can be obtained.

As the atmosphere in the heat treatment furnace 14 is heated by infrared radiation using the heater blocks A to R which are covered with the heat-resistant glass 10 on the sides facing to a center of the furnace, any particles do not enter the area where the material 12 to be treated is disposed in the furnace. Therefore, a particle collection filter, which tends to generate further particles, does not need to be provided. Furthermore, as a highly accurate control in soaking can be realized, a circulation fan is no longer required to uniformize the temperature of the atmosphere in the furnace. Thus, any stirring current, which generates particles and dust by crushing or wearing of the material 12, is not generated, thereby maintaining cleanliness in the heat treatment furnace.

(Second Embodiment)

Next, a second embodiment of the present invention will be explained below.

Figure 5A:
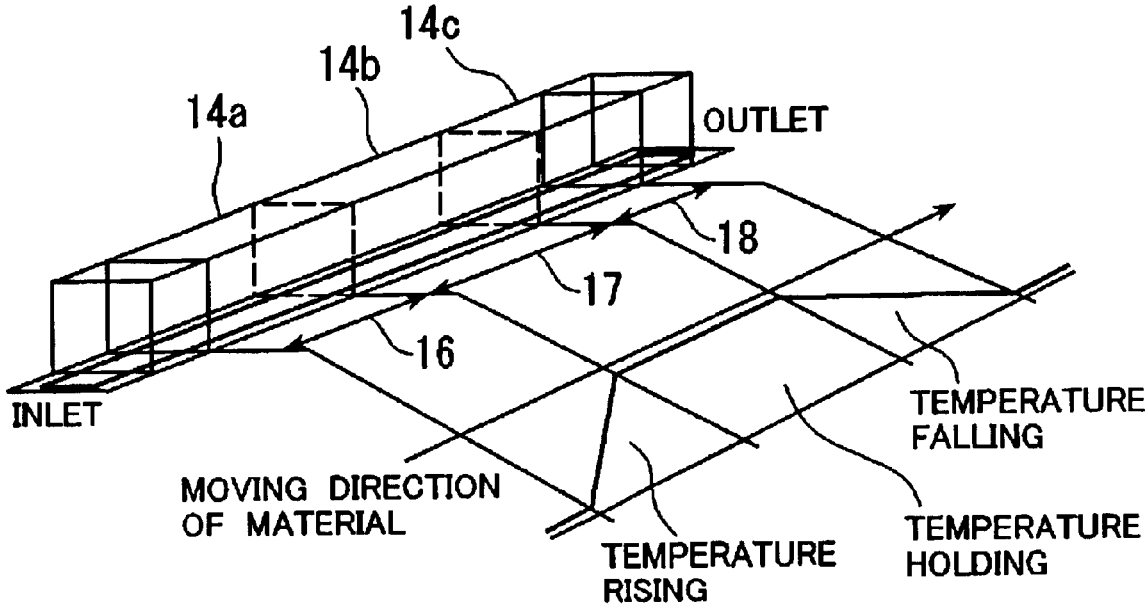
FIG. 5A is a diagram explaining a soaking apparatus according to a second embodiment of the present invention.
Figure 5B:
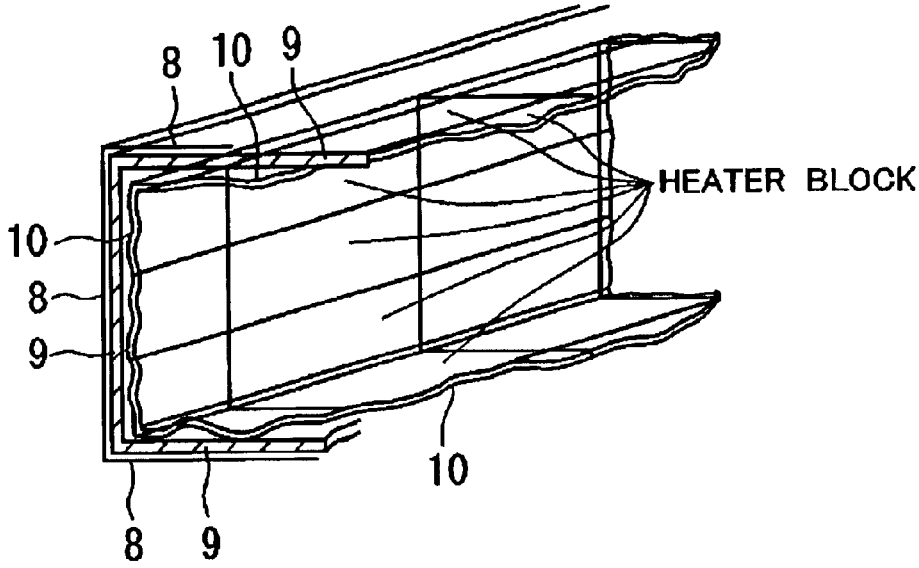
FIG. 5B is a diagram explaining a wall structure of the furnace of FIG. 5A.

FIG. 5A is a diagram explaining a soaking apparatus according to the second embodiment of the present invention, and FIG. 5B is a diagram explaining a wall structure of the furnace of FIG. 5A.

The soaking apparatus in accordance with the second embodiment is a continuous type heat treatment apparatus in which three treatment zones are continuously provided. A conveyor carrying the material 12 to be treated passes through a heat treatment furnace 14*a* as a temperature rising zone 16, a heat treatment furnace 14*b* as a temperature holding zone 17, and a heat treatment furnace 14*c* as a temperature falling zone 18 in sequence.

In this embodiment, the cooling device 8 in the temperature rising zone 16 and the temperature holding zone 17 as well as the insulating material 9 may be omitted if unnecessary.

FIG. 6A is a diagram explaining an arrangement of heater blocks mounted on the furnace, FIG. 6B is a graph of a set pattern of a temperature in the furnace, and FIG. 6C is a table showing a digitalized set pattern of each heater block.

On ceilings, floors and right/left walls of the heat treatment furnaces 14*a*, 14*b* and 14*c* of the temperature rising zone 16, the temperature holding zone 17 and the temperature falling zone 18, respectively, heater blocks N-A to N-L, by three per one surface, are mounted with their longitudinal directions in parallel to a moving direction of a material to be treated. Here, N is a natural number, and is 1 to 5 in the temperature rising zone 16, 6 to 10 in the temperature holding zone 17, and 11 to 15 in the temperature falling zone 18.

With the cooling device 8 mounted on the ceiling, the floor and the right/left walls, temperature lowering can be freely controlled.

As shown in FIG. 6C, a set value in the temperature is assigned to each of the heater blocks N-A to N-L of the heat treatment furnaces 14*a* to 14*c*, respectively. In this structure, the temperature can be automatically controlled by detecting an increase and decrease in the temperature compared to the set value.

As described above, as shown in FIG. 6B, the temperature of the material to be treated can be controlled in compliance with a predetermined set pattern of the temperature in the furnaces.

Next, a soaking apparatus of another embodiment according to the present invention is explained below.

Figure 7:
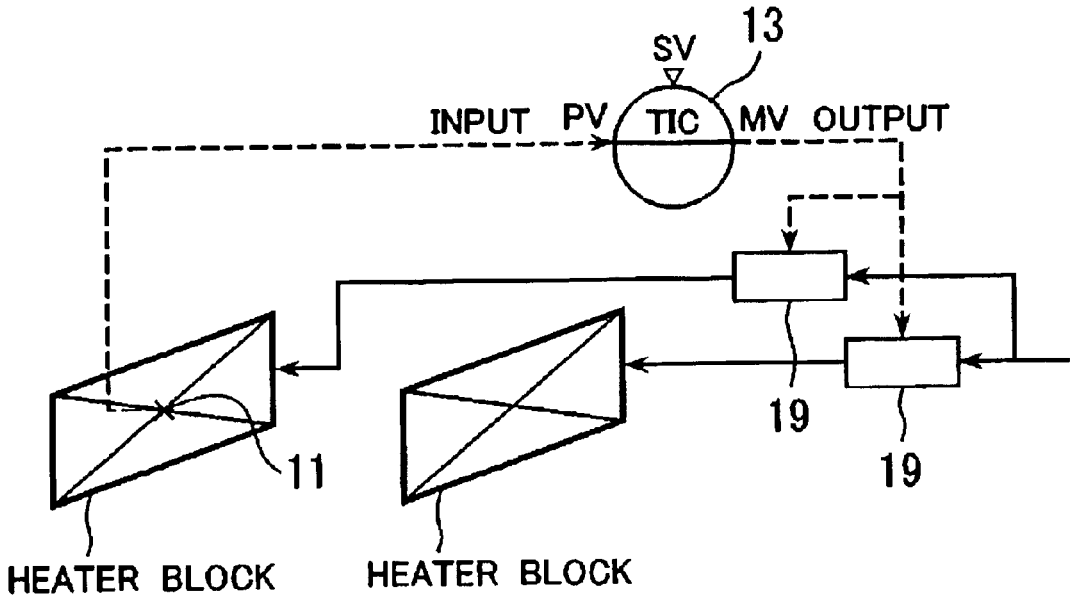
FIG. 7 is a diagram explaining a structure for controlling a thermal controller connected to a thermal sensor.

FIG. 7 is a diagram explaining a structure for controlling a thermal controller connected to a thermal sensor.

The thermal sensor 11 does not necessarily correspond to the heater blocks A to R one by one. The thermal controller 13 can raise and lower temperatures of a plurality of heater blocks on the basis of an input from one thermal sensor.

While particular embodiments of the present invention have been shown and described, numerous variations and alternate embodiments will occur to those skilled in the art. Accordingly, it is intended that the invention be limited only by the appended claims.

What is claimed is:

1. A soaking apparatus for soaking a material to be treated comprising:

a heat treatment furnace having a ceiling, a floor and a plurality of walls extending between said ceiling and said floor to define a closed interior space between said ceiling, said floor and said walls, each surface of said ceiling and said floor being divided into a plurality of sections, each surface of said walls being divided into a plurality of vertically spaced sections, at least one heater block mounted on each of said sections, a thermal sensor arranged in connection with each of said at least one heater block, and a thermal controller for controlling heating of said heater blocks based on a temperature measured by said thermal sensors such that each of said sections is heatable to a different temperature, wherein the material to be treated is placed into said closed interior space of said heat treatment furnace and said closed interior space is heated by said heater blocks.

2. The soaking apparatus according to claim 1, further comprising a cooling device for cooling said walls, said ceiling and said floor of the furnace, said cooling device being arranged in connection with outer surfaces of said walls, said ceiling and said floor opposite to surfaces on which the block heater blocks are mounted.

3. The soaking apparatus according to claim 1, further comprising a heat-resistant glass to separate areas on which the heater blocks are mounted from a space inside the heat treatment furnace situated in front of the heater blocks on a side facing to a center of the furnace.

4. The soaking apparatus according to claim 1, further comprising a cassette to hold a plurality of the materials to be arranged in parallel to each other, said cassette being detachably mounted in the heat treatment furnace.

5. The soaking apparatus according to claim 1, wherein said ceiling has a peripheral edge and said floor has a peripheral edge, lower edges of said walls extending entirely around said floor and upper edges of said walls extending entirely around said ceiling to thereby entirely close the space between said ceiling and said floor and define said closed interior space.

6. The soaking apparatus according to claim 1, wherein said wails include four walls, two of said walls being opposite one another and the other two of said walls being opposite one another.

7. A soaking apparatus for soaking a material to be treated comprising:

a heat treatment furnace having an inlet and an outlet and being divided into a plurality of heat treatment zones arranged one after another in a longitudinal direction between the inlet and the outlet, said heat treatment furnace having a ceiling, a floor and a plurality of walls extending between said ceiling and said floor, each surface of said ceiling and said floor being divided into a plurality of sections, each surface of said walls being divided into a plurality of rows arranged one above another, each of said rows in each of said heat treatment zones being divided into a plurality of longitudinally spaced sections arranged one after another in the longitudinal direction of the furnace, at least one heater block mounted on each of said sections, a thermal sensor arranged in connection with each of said heater blocks, a thermal controller for controlling heating of said heater blocks based on a temperature measured by said thermal sensors such that each of said sections is heatable to a different temperature and the temperature of said sections in each of said rows is variable from the inlet to the outlet, and a conveyor arranged in said heat treatment furnace to carry the material to be treated from the inlet of the furnace to the outlet of the furnace.

8. The soaking apparatus according to claim 7, further comprising a cooling device for cooling said walls, said ceiling and said floor of the furnace, said cooling device being arranged in connection with outer surfaces of said walls, said ceiling and said floor opposite to surfaces on which the heater blocks are mounted.

9. The soaking apparatus according to claim 7, further comprising a heat-resistant glass to separate areas on which the heater blocks are mounted from a space inside the heat treatment furnace situated in front of the heater blocks on a side facing to a center of the furnace.

10. The soaking apparatus according to claim 7, further comprising a cassette to hold a plurality of the materials to be arranged in parallel to each other, said cassette being detachably mounted in the heat treatment furnace.

11. The soaking apparatus according to claim 7, wherein said sections of said ceiling and said floor are arranged in longitudinally extending rows one alongside another, each of said rows in each of said heat treatment zones including a plurality of said sections arranged one after another in the longitudinal direction.

12. The soaking apparatus according to claim 7, wherein said sections of said floor are arranged in longitudinally extending rows one alongside another, each of said rows in each of said heat treatment zones including a plurality of said sections arranged one after another in the longitudinal direction.

13. The soaking apparatus according to claim 7, wherein said sections of said ceiling are arranged in longitudinally extending rows one alongside another, each of said rows in each of said heat treatment zones including a plurality of said sections arranged one after another in the longitudinal direction.

* * * * *